US005669170A

United States Patent [19]

Norris

[11] Patent Number: 5,669,170

[45] Date of Patent: Sep. 23, 1997

[54] HANDS-FREE SLING FOR CARRYING A LONG GUN OR OTHER ELONGATED ARTICLE

[76] Inventor: Terry Bruce Norris, 1411 Elderberry La., Klamath Falls, Oreg. 97601

[21] Appl. No.: 693,790

[22] Filed: Jul. 26, 1996

[51] Int. Cl.[6] ..... F41C 23/00; F41C 23/02

[52] U.S. Cl. ..... 42/85; 42/94

[58] Field of Search ..... 42/85, 94; 224/150, 224/158, 163

[56] References Cited

U.S. PATENT DOCUMENTS

| | | | |
|---|---|---|---|
| 3,819,094 | 6/1974 | Hyde | 224/1 R |
| 3,869,074 | 3/1975 | Roach | 224/1 R |
| 4,299,343 | 11/1981 | Atchisson | 224/149 |
| 4,331,271 | 5/1982 | Anderson | 224/150 |
| 4,555,051 | 11/1985 | Johnson | 224/150 |
| 4,562,945 | 1/1986 | Erlandson | 224/150 |
| 4,613,067 | 9/1986 | Gann | 224/150 |
| 4,760,944 | 8/1988 | Hughes | 224/205 |
| 4,817,835 | 4/1989 | Tarr, Jr. | 224/150 |
| 4,819,844 | 4/1989 | Niemela | 224/150 |
| 4,823,998 | 4/1989 | Johnson | 224/150 |
| 4,882,786 | 11/1989 | Gross | 2/94 |
| 4,964,553 | 10/1990 | Glynn | 224/149 |
| 5,056,253 | 10/1991 | Willumsen | 42/94 |
| 5,082,155 | 1/1992 | Salvador | 224/150 |
| 5,092,505 | 3/1992 | Olschlager | 224/150 |
| 5,110,022 | 5/1992 | Dvoroznak et al. | 224/150 |
| 5,282,558 | 2/1994 | Martinez | 224/150 |
| 5,325,618 | 7/1994 | Turner | 42/85 |
| 5,353,538 | 10/1994 | Hakedal et al. | 42/85 |
| 5,400,935 | 3/1995 | Farmer | 224/208 |

OTHER PUBLICATIONS

*Bow Harness*; Advertisement #19774 (date unknown).
*Combat Rifle Sling*, U.S. Cavalry, p. 74 (date unknown).
*Safari Sling*, #FF-21397, Cabela's, Fall 1995, p. 229.
*Leather Cordura Neoprene Slings*, Cabela's, Fall 1995, p. 229.

*Primary Examiner*—Charles T. Jordan
*Assistant Examiner*—Meena Chelliah
*Attorney, Agent, or Firm*—Klarquist Sparkman Campbell Leigh & Whinston

[57] ABSTRACT

A sling for a long gun and other articles has a belt that fits about the waist and a shoulder strap that passes over the shoulder and fastens to the belt at both ends. The shoulder strap includes two chest mounting members that hold a long gun adjacent the chest so that the user can carry the gun without using his hands. The belt, shoulder strap and mounting members are adjustable. The sling optionally includes a chest strap that fits around the chest and is coupled to the shoulder strap in the front and back.

7 Claims, 4 Drawing Sheets

HANDS-FREE SLING FOR CARRYING A LONG GUN OR OTHER ELONGATED ARTICLE

FIELD OF THE INVENTION

This invention relates to slings, and more specifically relates to a sling for carrying a long gun or other elongated article.

BACKGROUND OF THE INVENTION

A common drawback of prior gun slings is that they require a person wearing the sling to use his or her hands to keep a gun steady and safely positioned against the body. This type of sling limits the user's ability to work with his or her hands while carrying a gun and carrying other gear. If the user takes his hands off the gun, the gun is no longer secure and becomes a safety hazard. When the gun hangs loosely, it is more likely to get caught on something or discharge accidently.

Some types of gun slings pose an additional hazard because they are designed to hold a long gun outside the user's view. For example, many shoulder mounted slings are worn such that the long gun is positioned at the user's back. This prevents the user from seeing the gun, and specifically, from seeing whether the gun's safety is on. In addition, it is difficult for the user to keep the gun from getting caught on brush or branches when he or she cannot see it.

Another drawback of conventional gun slings is that they are difficult to wear and use when the user is carrying other gear. If the user is wearing a back pack for example, many shoulder-mounted slings are difficult to use because the pack tends to obstruct the user's access to the gun. These types of gun slings can limit the user's ability to safely access a gun in a sling while hiking and carrying other gear.

A related drawback of conventional slings is that they often require the sling to be fastened to the gun. Common types of gun slings mount to a rifle or shotgun at the barrel and stock. Since the gun sling remains fastened to the rifle, the sling often gets in the user's way when he tries to move it to the firing position. These types of slings pose a safety hazard because they can get caught on brush, tree branches and even the user's gear. These types of slings are inconvenient because they are often not easily adaptable to different types and sizes of guns.

Because of these and other drawbacks of conventional slings, there is a need for an improved sling design that enables the user to carry a long gun in a safe and accessible position without requiring the user to use his hands to hold the gun securely.

SUMMARY OF THE INVENTION

The invention provides an improved gun sling design that enables the user to carry a long gun securely without using his or her hands. While primarily designed to carry a long rifle, the sling can be used to carry other items such as a bow or long tools.

The gun sling comprises a belt that fastens around the waist, a shoulder strap coupled to the belt at both ends, and chest mounting members that hold a long gun securely against the chest. The belt and shoulder strap can be adjusted to fit varying body sizes, and the chest mounting members can be adjusted to fit a variety of long guns and other articles. In one version of the gun sling, the ends of the shoulder strap are coupled to the belt so that they can slide along the length of the belt. This enables the shoulder strap to move relative to the belt so that it can be worn over either shoulder and can be easily removed from the belt.

To add additional support, the gun sling can also include a chest strap that fits around the chest and couples to the shoulder strap at the front and back. At least one end of the chest strap has a fastener that allows the user to fasten and remove the chest strap from the shoulder strap. The chest strap can also include adjustable fasteners to adjust the length of the chest strap. In addition, the chest strap can be coupled to the shoulder strap in the front or back so that it can be adjusted up and down in the vertical direction. This enables the user to adjust the position of the chest strap for body size.

The features of the gun sling summarized here provide a number of advantages. A significant advantage of the sling is that it allows the user to hold a long gun securely against the chest without using his or her hands. It allows the user to see the gun at all times and further enables him to remove the gun from the sling and move it to firing position safely and quickly. The chest mounting members remain coupled to the shoulder strap, not the gun itself, and therefore, no part of the sling has to remain on the rifle when it moves to the firing position. As such, the sling provides no hindrance in moving the gun to firing position.

Further advantages and features will become apparent with reference to the following detailed description and accompanying drawings.

DETAILED DESCRIPTION

Figure 1:
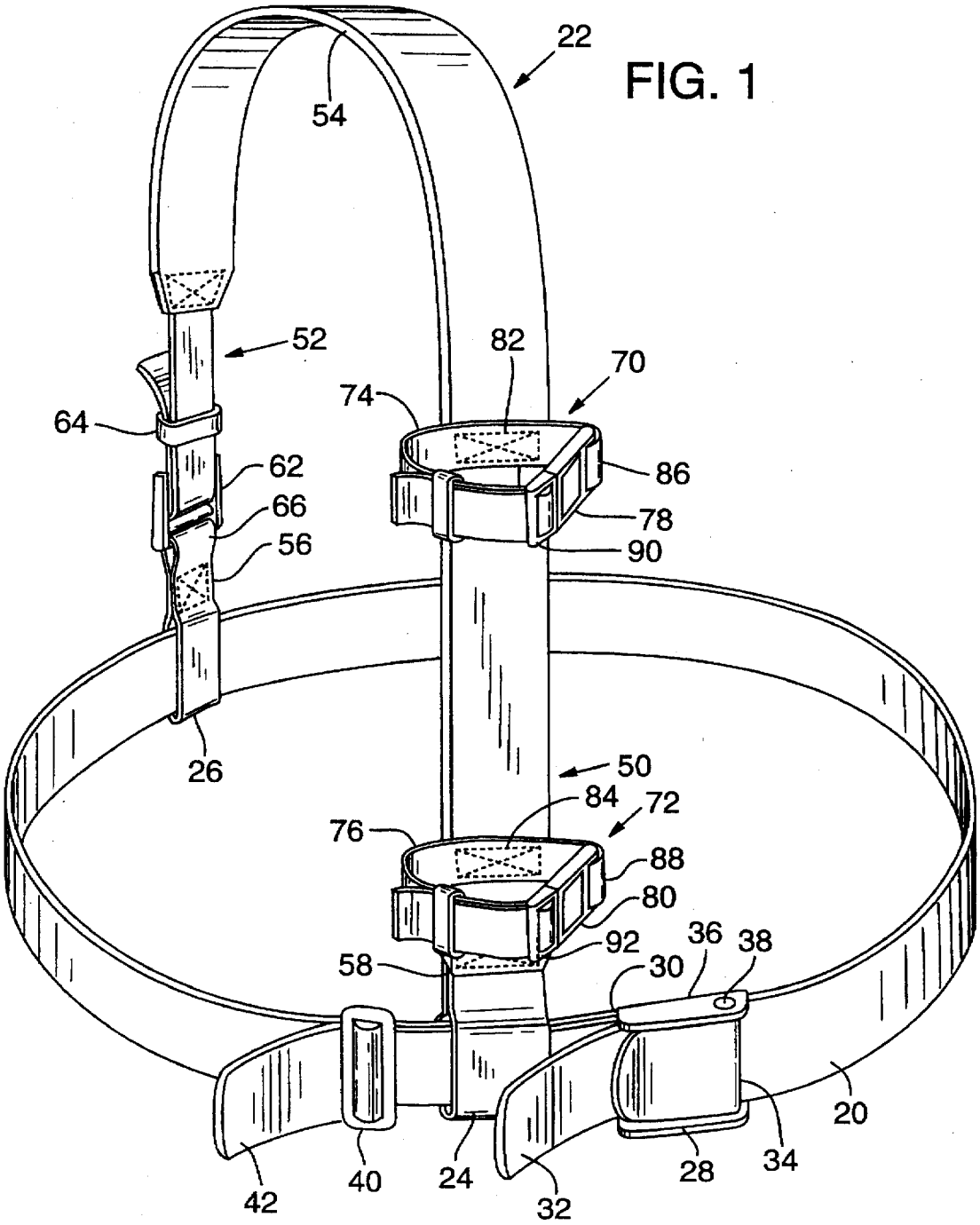
FIG. 1 illustrates a sling according to one embodiment of the invention.

FIG. 1 illustrates an embodiment of the invention. This embodiment is a sling, which is primarily designed to carry a long gun, but may also be used to carry other oblong articles such as a bow, fishing gear, tools, etc. Designed to fit about the torso, the sling enables the user to carry a long gun or other long article without using his or her hands to support or stabilize it. The user can adjust the sling a number of important ways, including adjusting mounting members on the sling to fit a long gun or other article and adjusting the size of the sling to fit about the body.

The gun sling is designed to fit over the users shoulder and about his or her waist. It comprises a belt 20 that fits about the waist and a shoulder strap 22 that passes over the shoulder and fastens to the belt at first and second ends 24, 26 of the strap 22.

The belt 20 is equipped with a belt fastener 28 to fasten the belt securely around the waist. In this embodiment, the belt fastener 28 is a cam buckle fixed to one end 30 of the belt 20. The other end 32 of the belt 20 slides between a cam portion 34 and fastening member 36. The cam portion pivots about a hinge 38 and clamps down on the second end of the belt 32 to hold it in place. To fasten the belt about the waist, the user passes the end of the belt through the cam portion 34 and fastening member 36 and then pivots the cam portion against the belt to hold it in place. While this version of the gun sling employs a cam buckle, a variety of other conventional belt fasteners can be used in the alternative.

In this particular embodiment, the belt 20 is comprised of nylon web and is approximately two inches wide. While this type of material and size is durable and provides a comfortable fit, a variety of other materials and sizes can be used instead.

The belt 20 shown in FIG. 1 is fitted with an adjustable fastener 40 that allows the user to adjust the length of the belt. The adjustable fastener is a slip lock nylon buckle 40, which can be moved anywhere along the belt but is preferably located somewhere near the cam buckle 28. The end 42 of the belt 20 slides through the fastening member 36 of the cam buckle 28 and then through the slip lock buckle 40. To adjust the size of the belt, the user slides a variable length portion of the belt through the fastening member 36 of the cam buckle 28, folds the belt back against itself, and slides the end 42 of the belt through the slip lock 40 to hold it in place. The user can further adjust the belt by sliding the slip lock buckle 40 along the length of the belt 20 in either direction.

The shoulder strap 22 passes over the shoulder and is coupled to the belt 20 at the far ends, or opposite, of the strap 24, 26. The strap 22 comprises a front chest portion 50 extending from the first end 24 of the shoulder strap, a back portion 52 extending from the second end 26 of the strap, and a shoulder portion 54 positioned between the front chest and back portions 50, 52 of the strap. The shoulder strap 22 is substantially comprised of nylon web, and the front chest portion and shoulder portion of the strap can be padded to provide a more comfortable fit. The nylon web is light, strong, and performs well in rugged environments, and therefore is the preferred material for the shoulder strap. However, the shoulder strap can be made of a variety of other materials.

The ends 24, 26 of the shoulder strap are coupled to the belt 20 so that they can slide along the length of the belt. As shown in FIG. 1, both ends of the shoulder strap 22 comprise a strap fastener 24, 26, which in this particular embodiment is a loop of nylon web that fits around the belt. The first end 24 of the shoulder strap is coupled to the belt 20 such that the range of sliding motion of shoulder strap is limited between first and second belt members 28,40. The sliding motion of the first end 24 of the belt is limited by the cam buckle 28 and the slip lock buckle 40 so that the first end of the shoulder strap remains coupled to the belt in a limited length section in front of the body. Both the slip lock buckle 40 and the cam buckle 28 can be adjusted to a variety of positions across the front of the user's body. This enables the user to wear the shoulder strap 22 over either shoulder and to position the shoulder strap 22 at the belt 20 as desired.

Like the first end 24 of the shoulder strap 22, the opposite end 26 forms a loop of the nylon web around the belt 20 such that it can slide along the length of the belt. While this end 26 of the shoulder strap is comprised of a loop of nylon web, other materials such as leather or rubber may be used in the alternative. The sliding relationship between the shoulder strap and the belt is preferable because it allows the strap to be easily removed from the belt by simply sliding the first and second ends of the strap off the end of the belt. It also provides a more comfortable fit because it moves to fit to the body and enables the strap to be worn over either shoulder. While the strap fasteners in this embodiment are closed loops of nylon web, the shoulder strap can be coupled to the belt in a variety of other ways. For example, the ends of the shoulder strap can be stitched directly to the belt or fastened to the belt using a strap fastener that allows the user to attach and detach the shoulder strap such as a slip lock buckle, a snap fastener, etc. Preferably, the strap fastener should attach the strap to the belt so that the user can easily remove and re-attach the strap to the belt.

As shown in FIG. 1, the length of the shoulder strap can be adjusted to fit varying body sizes because it includes an adjustable fastener 62. In this particular embodiment, the adjustable fastener is located at the back portion 52 of the shoulder strap. One end of the nylon webbing of the shoulder strap 22 is threaded through the adjustable fastener 62 and held in place against the strap by a clasp 64. The adjustable fastener 62 is coupled to the second end 26 of the shoulder strap by a closed loop of nylon web 66 formed by stitching a section of nylon web together as shown in FIG. 1 (see the bar tack stitch 56, for example).

The front chest portion 50 of the shoulder strap is coupled to first and second chest mounting members 70 and 72. First and second chest mounting members 70 and 72 are each comprised of an article strap 74, 76, designed to fit about the cross section of a long rifle, or other oblong article, and a fastener 78, 80 to fasten the article strap 74, 76 around the long rifle. As shown in FIG. 1, the article straps 74, 76 are attached to the front chest portion of the shoulder strap by stitching 82, 84. In this particular embodiment, the article strap fastener 78, 80 is a top release buckle coupled to opposing ends of the article strap (74, for example). The top release buckles 78 and 80 enable the user to adjust the length of the article straps to fit about a long rifle or other article. One end of the article strap 86, 88 is looped about a receptacle portion of the buckle (78, 80), while the other end of the strap is looped through the insert portion 90, 92 of the top release buckle.

To fasten the article strap about the rifle, the user inserts the insert portion 90, 92 of the buckle into the receptacle portion 78, 80. The insert portion snaps in place and locks to form a closed loop around the gun. The user can adjust the length of the strap by sliding one end of the article strap in either direction through the insert portion 90, 92 of the buckle. To release the buckle, the user presses the top release of the insert portion, allowing the insert to slide free from the receptacle portion. While this specific version of the gun sling uses a top release type buckle a variety of releasable fasteners can be used in the alternative. Preferably the fastener should lock securely about the gun, yet should release quickly so that the user can remove the gun quickly and easily.

Figure 2:
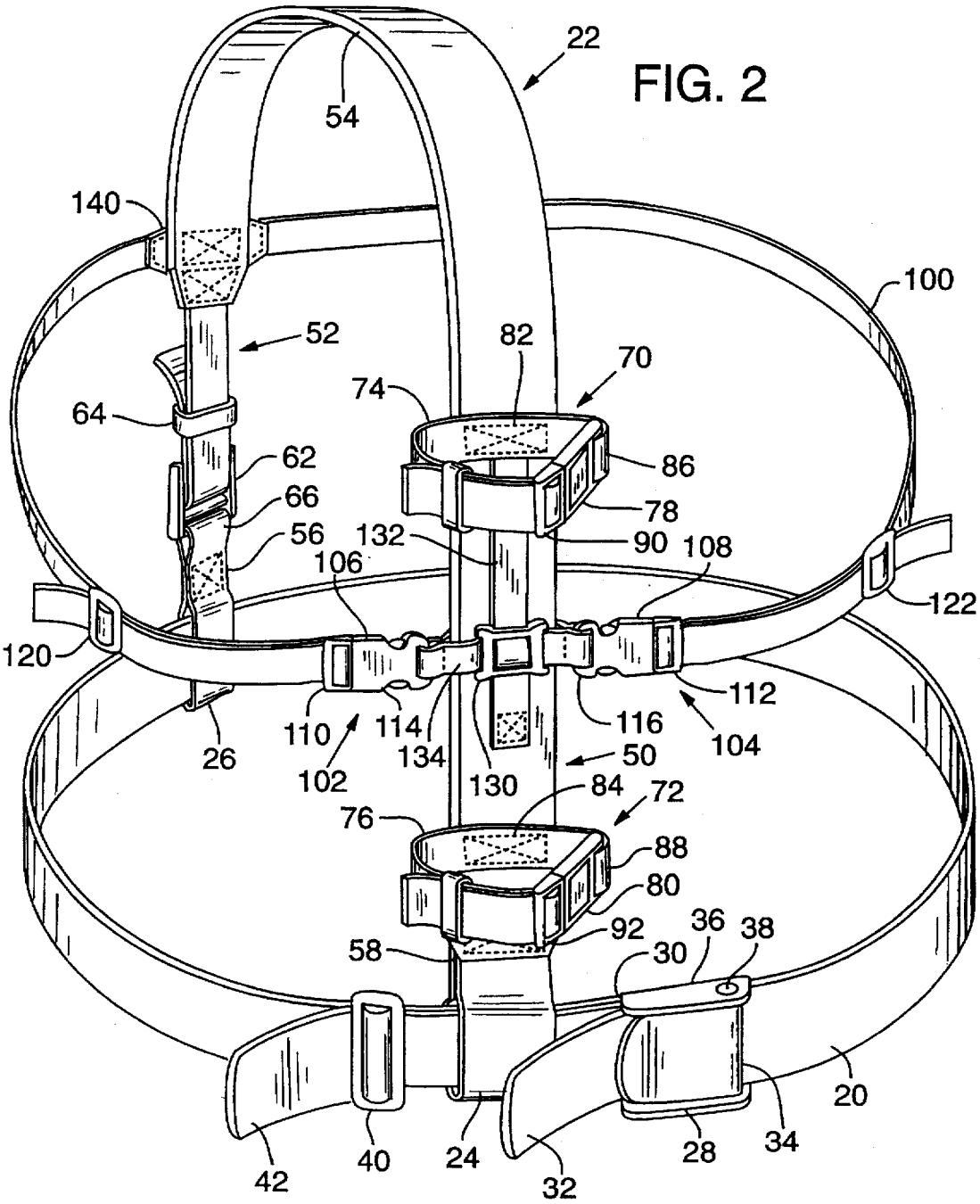
FIG. 2 illustrates an alternative embodiment of the gun sling in FIG. 1.

FIG. 2 illustrates another embodiment of a sling according to the invention. Many parts are similar to that described regarding FIG. 1 and are similarly numbered. This version of the gun sling includes a chest strap 100, which is coupled to the front and back portions of the shoulder strap to provide additional support for the sling and the sling's contents. Like the belt 20, the chest strap is preferably made of nylon web, although other materials can also be used. The chest strap 100 wraps around the chest, and its ends 102, 104 are coupled to the front chest portion of the shoulder strap. In this particular embodiment, the ends 102, 104 of the chest strap are coupled to fasteners 106, 108 that enable the user to attach and remove the ends of the chest strap from the front portion of the shoulder strap. The specific fasteners used in this embodiment are side release buckles each comprised of two cooperating members: an insert portion 110, 112 and a receptacle portion 114, 116. The insert portion 110, 112 slides into and locks with a receptacle portion 114, 116. Each end of the chest strap is looped through the insert portion 110, 112 of the slip lock buckles and is adjustable in length using adjustable fasteners 120 and 122. As shown in FIG. 2, these adjustable fasteners are slip lock buckles that enable the user to adjust the lengths of the chest strap at each end.

One optional feature of the chest strap 100 shown in FIG. 2 is the manner in which it can be adjusted vertically and horizontally relative to the substantially vertical orientation of the shoulder strap 22. To allow the user to adjust the chest strap vertically, the ends of the chest strap are coupled to a fastener 130 that can slide along a vertical band 132 affixed to the shoulder strap. As shown, the far ends of this vertical band 132 are stitched to the front portion of the shoulder strap 22. The vertical band, like the other components of the gun sling, is made of a nylon web. The fastener 130 is a sliding fastener which can slide vertically along the band 132 and is held in place by friction between the vertical band and the fastener. Together, the fastener 130 and vertical band 132 form a vertically adjustable fastener that enables the user to position the chest strap at a plurality of different positions along the vertical direction of the chest strap. To provide further vertical adjustment, a similar arrangement can be used at the point 140 where the chest strap is affixed to the back portion of the shoulder strap.

The chest strap 100 can also be adjusted horizontally by sliding a section of nylon web 134 in a horizontal direction through the fastener 130. The section 134 of nylon web is looped about the receptacle portions 114, 116 of the side release fasteners at each end of the chest strap.

This optional feature 130 and vertical band 132 could be eliminated by sewing 134 permanently to the shoulder strap 22 below the article strap 74.

Figure 5:
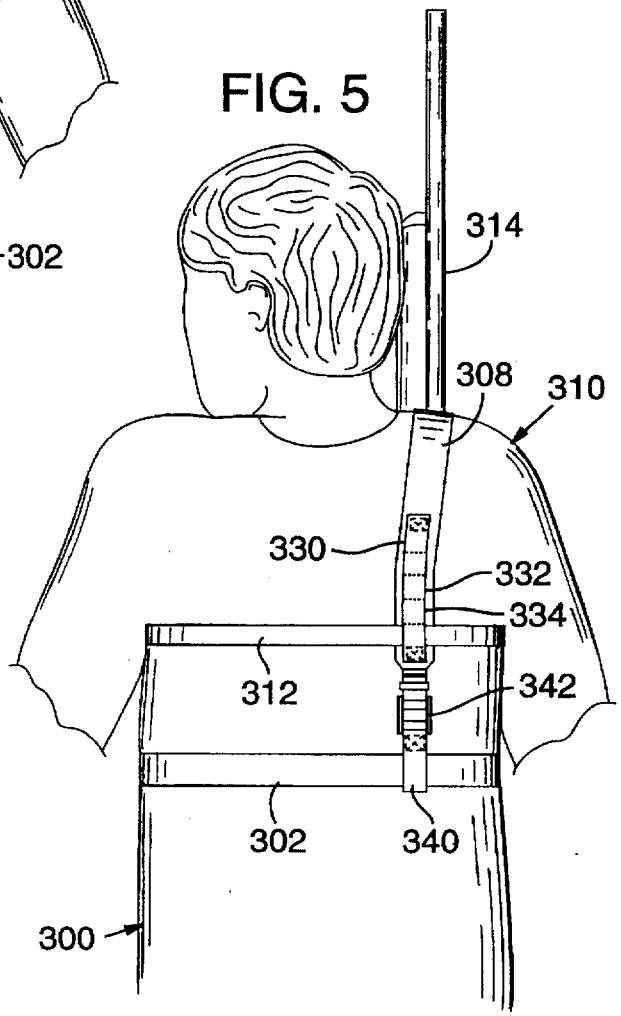
FIG. 5 illustrates how the sling shown in FIG. 4 fits about the user's back.

As shown in FIG. 2, the chest strap 100 is coupled to the back portion 52 of the shoulder strap. Specifically, the chest strap 100 is stitched using a bar tack stitch to the back portion of the shoulder strap 22. As an alternative, the chest strap can be coupled to the back portion of the shoulder strap 22 by a conventional fastener such as a buckle, cooperating snaps, a button, etc. To make the connection point of the chest strap to the back portion of the shoulder strap adjustable, a number of fasteners or sliding fasteners can be positioned along the vertical direction of the shoulder strap. One possible configuration, illustrated in FIG. 5 is a vertical band of nylon webbing stitched to the shoulder strap at successive intervals to form a series of loops. With this type of configuration, the user can adjust the vertical position of the chest strap by selecting one of the loops to pass the chest strap through.

Figure 3:
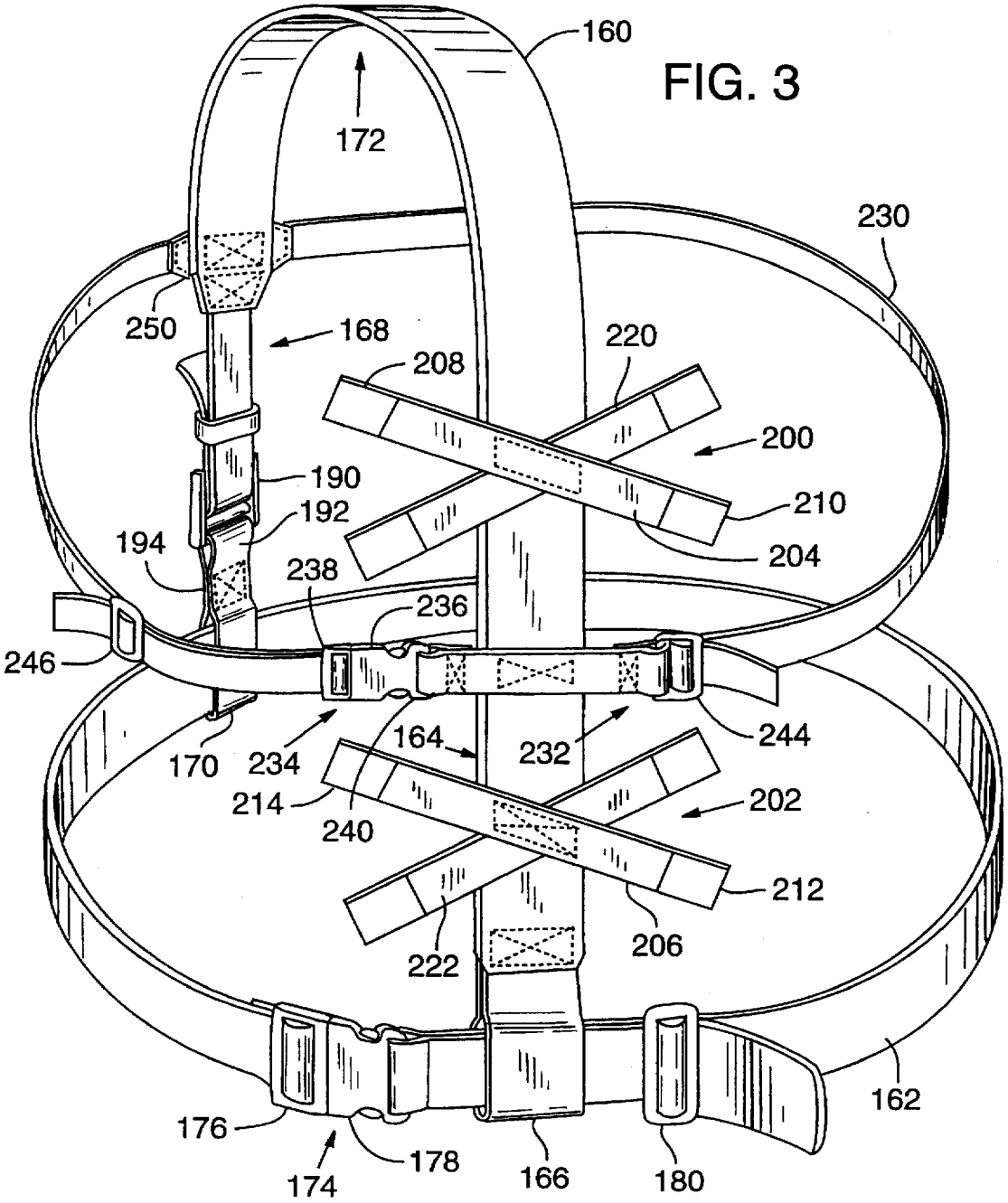
FIG. 3 illustrates another alternative embodiment of the gun sling.

FIG. 3 illustrates an alternative embodiment of the gun sling shown in FIG. 1. This gun sling is similar to the sling illustrated in FIG. 1 but employs different types of adjustable fasteners and chest mounting members.

Like the gun sling in FIG. 1, this gun sling includes a shoulder strap 160 coupled to a belt 162 at each end. The shoulder strap 160 has a front portion 164 that extends from its first end 166, a back portion 168 that extends from the other end 170, and a shoulder portion 172 positioned between the front and back portions. The shoulder strap 160 is designed to extend from the first end near the abdomen, pass across the chest, rest on the shoulder, extend down the back and attach to the belt at the user's lower back.

The belt 162 is fastened about the waist by a belt fastener 174. Like the belt fastener in the embodiment shown in FIG. 1, this belt fastener is a buckle. However, this particular buckle is a side release buckle comprising an insert portion 176 and a locking receptacle portion 178. One end of the belt 162 is affixed to the insert portion of a buckle, while the other end of the belt is looped around the locking portion 178 of the buckle 174. The length of the belt is adjustable using an adjustable fastener such as slip lock buckle 180 shown in FIG. 3. Preferably, the belt is comprised of a nylon web, but a variety of other conventional materials may be used as well.

The shoulder strap is slidably coupled to the belt at each end 166, 170. In this embodiment, a loop of the nylon web forms a slidable fastener at each end of the shoulder strap 166, 170. The loop at each end of the shoulder strap is formed by stitching a section of the nylon web of the shoulder strap 160 to itself to form the closed loop. The back portion of the shoulder strap includes adjustable fastener 190 to adjust the length of the shoulder strap for body size. At one end of the fastener 190, a section of nylon web is looped through the fastener and is adjustable. The other end of the fastener 190 is coupled to a closed loop of nylon web 192 formed by stitching a loop of the nylon web as shown.

The front portion of the shoulder strap 160 is coupled to first and second chest mounting members 200, 202 for holding a long rifle or other article against the shoulder strap 160. Each of the first and second mounting members are comprised of article straps 204, 206 that form a common loop around the cross section of a long rifle. Each end of the article straps 208, 210, 212, 214 has hook and loop-style fasteners material thereon, such as Velcro®, which mates with an opposing end of the article strap. To provide additional support, chest mounting members can include an additional article strap 220, 222, which is similar to the first chest strap in each chest mounting member. Each of the article straps are coupled to the front portion of the shoulder strap. In this case, the article straps are stitched to the front portion of the shoulder strap.

The gun sling shown in FIG. 3 optionally includes a chest strap 230 to provide additional support. Each end of the chest strap 232, 234 is coupled to the front portion of the shoulder strap. In this particular embodiment, a first end 234 of the chest strap is removably attached to the front portion of the shoulder strap by a fastener 236. The fastener comprises a side release buckle with an insert portion 238 and a locking receptacle portion 240. The first end 234 of the chest strap 230 is looped through the insert portion 238 of the side release buckle 236. The locking portion 240 of the side release buckle 236 is coupled to a section of nylon web 242 stitched to the front portion of the shoulder strap. The other end 232 of the chest strap 230 is coupled to the front portion of the shoulder strap 160 by fastener 244, which connects the end of the chest strap to the section of nylon web 242 stitched to the shoulder strap.

The length of chest strap 230 is adjustable using an adjustable fastener 246. In this particular embodiment, the adjustable fastener is a slip lock buckle which enables the user to adjust the length of one end of the chest strap.

As shown in FIG. 3, the chest strap is attached to the front and back portions of the shoulder strap. While not adjustable in the vertical direction, the shoulder strap and chest strap can be modified such that the user can attach and detach the chest strap to the shoulder strap at a variety of vertical positions along the front portion shoulder strap as shown in FIG. 2. The rear portion of the chest strap 230 is coupled to the back portion of the shoulder strap. Specifically, the chest strap 230 is stitched to the back portion of the shoulder strap as shown 250. The chest strap can also be made adjustable as shown in FIG. 5.

As noted throughout the description above, it is possible to modify the design of the gun sling without departing from the scope of the invention. One possible variation of the gun sling is to mount the shoulder strap shown in FIG. 1 or FIG. 2 to a conventional belt worn about a persons waist. In this particular configuration, it is not necessary that a special purpose belt be provided with a gun sling. Rather, the gun sling simply comprises the shoulder strap and first and second chest mounting members coupled to the front chest portion of the shoulder strap. Each end of the shoulder strap can then be coupled to a conventional belt worn about a persons waist. For example, the first and second ends 24 and 26 of the shoulder strap 22 shown in FIG. 1 can be coupled to a conventional belt by sliding the belt through the loops at each end of the shoulder strap. As another example, the ends 24, 26 of the shoulder strap can be fastened to a belt strap of a pack or to military loops or rings on a pack jacket, or pants.

Figure 4:
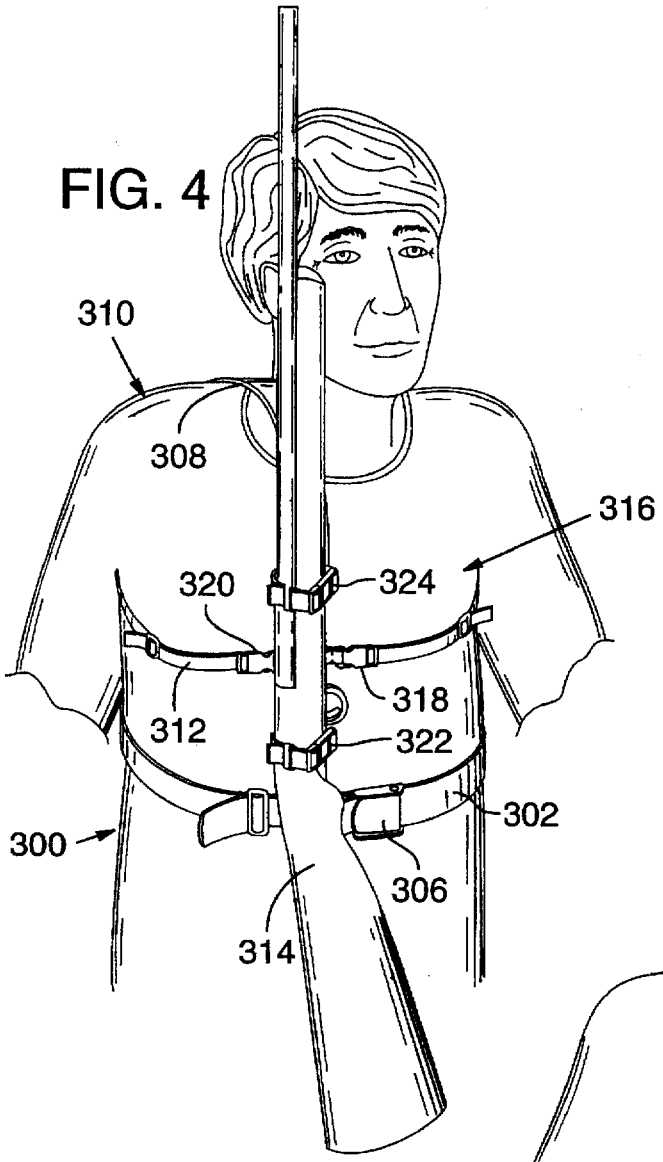
FIG. 4 illustrates how one embodiment of the gun sling is worn on a user.

FIG. 4 illustrates how one embodiment of the gun sling is worn on the user 300. As shown, the belt 302 circles about the user's waist 304 and fastens in the front at the belt fastener 306. The shoulder strap 308 extends up from the belt, crosses over the chest and rests on the shoulder 310. The chest strap 312 secures the guns sling and gun 314 against the chest 316. It circles the torso and is fastened at the front portion of the shoulder strap by fasteners 318, 320.

As shown in FIG. 4, the sling is primarily designed to hold a long gun 314 against the chest. However, the sling may also be used for carrying other oblong shaped or elongated articles such as a bow or longer tools (e.g., shovel, axe, etc.). In this example, the first and second chest mounting members 322, 324 fasten about the cross section of the long gun 314 and hold it securely against the chest. The user can easily remove the first and second chest mounting members from the long gun by releasing the fasteners on the articles straps. This enables the user to quickly transition from a hands free position to a firing position.

FIG. 5 illustrates how the sling fits about the user's back. As shown, the belt 302 circles about the waist near the lower back. If the gun sling is equipped with a chest strap, it circles about the back and is coupled to the back portion of the shoulder strap.

This version of the gun sling illustrates how the user can adjust the vertical position of the chest strap 312. A vertical band 330 is attached to the substantially vertical shoulder strap in a vertical direction. At spaced intervals, the vertical band is stitched to the shoulder strap to form a series of loops (332, 334, for example). The user can pass the shoulder strap through any of these loops to adjust the vertical position of the chest strap.

The shoulder strap 308 crosses over one of the shoulders 310 and is slidably attached to the belt 302 near the user's lower back. The end 340 of the shoulder strap can slide along the belt horizontally. The shoulder strap includes an adjustable fastener 342 so that the length of the shoulder strap can be adjusted for body size.

Having described and illustrated the principles of our invention with reference to a preferred embodiment and several variations thereon, it should be apparent that the invention can be modified in arrangement and detail without departing from its principles. Accordingly, we claim all modifications as may come within the scope and spirit of the following claims.

I claim:

1. A sling for holding an elongated article adjacent a chest of a user wearing the sling, the sling comprising:

a belt including a belt fastener operable to fasten the belt around a waist; a shoulder strap including first and second ends coupled to the belt, a front chest portion extending from the first end, a back portion extending from the second end, and a shoulder portion positioned between the front chest and back portions and operable to rest on a shoulder;

first and second chest mounting members coupled to the front chest portion of the shoulder strap, the first and second chest mounting members being operable to removably support the elongated article adjacent the chest of the user; and a chest strap coupled to the shoulder strap at the front chest and back portions, the chest strap being operable to hold the sling around the chest of the user.

2. The sling of claim 1 wherein the shoulder strap includes a vertically adjustable fastener at either the front chest or back portions, wherein the vertically adjustable fastener is operable to couple the chest strap to the shoulder strap at a plurality of different vertical positions along the length of the shoulder strap.

3. The sling of claim 1 wherein the chest strap includes a first and second end, at least one of the first and second ends including a fastener operable to removably attach the chest strap to the front chest portion of the shoulder strap.

4. The sling of claim 3 wherein at least one of the first and second ends of the chest strap have a first cooperating buckle member, and the front chest portion has a second cooperating buckle member;

wherein the first and second cooperating buckle members are operable to removably attach at least one of the first or second ends of the chest strap to the front chest portion.

5. A sling for holding an elongated article adjacent a chest of a user wearing the sling, the sling comprising:

a belt including a belt fastener operable to fasten the belt around a waist;

a shoulder strap including first and second ends coupled to the belt, a front chest portion extending from the first end, a back portion extending from the second end, and a shoulder portion positioned between the front chest and back portions and operable to rest on a shoulder; and first and second chest mounting members coupled to the front chest portion of the shoulder strap, the first and second chest mounting members being operable to removably support the elongated article adjacent the chest of the user;

wherein the first and second chest mounting members are elongated straps having hook and loop fasteners portions for releasable engagement.

6. A sling for holding an elongated article adjacent a chest of a user wearing the sling, the sling comprising:

a belt including a belt fastener operable to fasten the belt around a waist;

a shoulder strap including first and second ends coupled to the belt, a front chest portion extending from the first end, a back portion extending from the second end, and a shoulder portion positioned between the front chest and back portions and operable to rest on a shoulder; and first and second chest mounting members coupled to the front chest portion of the shoulder strap, the first and second chest mounting members being operable to removably support the elongated article adjacent the chest of the user;

wherein the first and second chest mounting members each comprise an article strap with first and second ends, either the first or second ends of the article strap, or both, coupled to a fastener for removably fastening the article strap about the article to be secured therein.

7. The sling of claim 6 wherein the article strap is adjustable.

* * * * *